US006939040B2

(12) United States Patent
Schneider

(10) Patent No.: US 6,939,040 B2
(45) Date of Patent: Sep. 6, 2005

(54) RECLOSABLE PACKAGE HAVING FILM THAT CURLS OR BENDS AWAY FROM SLIDER

(75) Inventor: John H. Schneider, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 168 days.

(21) Appl. No.: 10/262,174

(22) Filed: Nov. 7, 2002

(65) Prior Publication Data

US 2004/0091178 A1 May 13, 2004

(51) Int. Cl.[7] ..... B65D 33/16

(52) U.S. Cl. ..... 383/61.2; 383/64; 383/204; 53/412

(58) Field of Search ..... 383/8, 61.2–61.3, 383/64–65, 35, 43, 203–204; 24/399–400; 53/412

(56) References Cited

U.S. PATENT DOCUMENTS

| | | | | |
|---|---|---|---|---|
| 3,416,991 | A | | 12/1968 | Yoshimura |
| 3,620,896 | A | | 11/1971 | Glasgow |
| 3,932,257 | A | | 1/1976 | Noguchi |
| 4,198,458 | A | | 4/1980 | Mitsuishi et al. |
| 4,274,900 | A | | 6/1981 | Mueller et al. |
| 4,479,244 | A | | 10/1984 | Ausnit |
| 4,988,465 | A | | 1/1991 | Lustig et al. |
| 5,403,668 | A | | 4/1995 | Wilhoit |
| 5,510,165 | A | | 4/1996 | Seki |
| 5,713,669 | A | * | 2/1998 | Thomas et al. ..... 383/204 |
| 6,257,763 | B1 | * | 7/2001 | Stolmeier et al. ..... 383/5 |
| 6,273,607 | B1 | * | 8/2001 | Buchman ..... 383/5 |
| 6,286,191 | B2 | * | 9/2001 | Van Erden ..... 24/399 |
| 6,291,037 | B1 | | 9/2001 | Bakker et al. |
| 6,371,643 | B2 | | 4/2002 | Saad et al. |
| 6,409,384 | B1 | * | 6/2002 | Provan et al. ..... 383/5 |
| 6,461,043 | B1 | * | 10/2002 | Healy et al. ..... 383/204 |
| 6,505,383 | B2 | * | 1/2003 | Machacek et al. ..... 24/30.5 R |

* cited by examiner

*Primary Examiner*—Jes F. Pascua
(74) *Attorney, Agent, or Firm*—Ostrager Chong Flaherty & Broitman P.C.

(57) ABSTRACT

A reclosable package comprises a receptacle and a header that communicate via a mouth, and a slider-zipper assembly disposed in the mouth, the slider being exposed when a first portion of the header is removed. The header further comprises second and third portions having respective states of tension that will cause the second and third portions of the header to curl or bend away from the slider when the first portion of the header is removed, for example, by tearing or cutting. The second and third portions of the header curl or bend in opposite directions to allow easy access to the slider by the consumer. In a method of manufacture, the second and third portions of the header are heat treated to produce differential shrink tension states. Alternatively, the header material can be a thermoplastic laminate film in which the layers have different shrink tension states.

37 Claims, 3 Drawing Sheets

RECLOSABLE PACKAGE HAVING FILM THAT CURLS OR BENDS AWAY FROM SLIDER

BACKGROUND OF THE INVENTION

This invention generally relates to reclosable pouches, bags or other packages of the type in which material, such as foodstuff, detergent, etc., may be stored.

Reclosable bags are finding ever-growing acceptance as primary packaging, particularly as packaging for foodstuffs such as cereal, fresh vegetables, snacks and the like. Such bags provide the consumer with the ability to readily store, in a closed, if not sealed, package any unused portion of the packaged product even after the package is initially opened. To gain acceptance as a primary package for foodstuffs, it is virtually mandatory that the package exhibit some form of tamper evidence to protect the consumer and maintain the wholesomeness of the contained product. In addition, in many cases it is necessary that food product be hermetically packaged.

Reclosable fastener assemblies are useful for sealing thermoplastic pouches or bags. Such fastener assemblies typically include a plastic zipper and a plastic slider. Typically, the plastic zippers include a pair of interlockable profiled members that form a closure. As the slider moves across the profiles, the profiles are opened or closed. The profiles in plastic zippers can take on various configurations, e.g. interlocking rib and groove elements having so-called male and female profiles, interlocking alternating hook-shaped closure members, etc. Reclosable bags having slider-operated zippers are generally more desirable to consumers than bags having zippers without sliders because the slider eliminates the need for the consumer to align the interlockable zipper profiles before causing those profiles to engage.

In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Other types of slider-operated zipper assemblies avoid the use of a separating finger. For example, U.S. Pat. No. 6,047,450 discloses a zipper comprising a pair of mutually interlockable profiled closure members, portions of which form a fulcrum about which the profiled closure members may be pivoted out of engagement when lower edges of the bases are forced towards each other.

It is known to manufacture bags or pouches in which a slider-zipper assembly is enclosed by a header. Typically, means are provided for enabling a top portion of the header to be torn or cut off, thereby giving the consumer access to the slider. The tear line or cut line may be situated at an elevation higher than the top of the zipper so that the zipper does not interfere with tearing away or cutting off of the header top portion. In such cases, the remaining portions of the header on both sides of the zipper cover parts of the slider, thereby limiting the consumer's access to the slider. There is a need for a reclosable package in which the remainder of the torn-open header poses less of an obstacle to digital gripping of the slider by the consumer.

BRIEF DESCRIPTION OF THE INVENTION

The invention is directed to slider-operated reclosable packages designed so that the slider is easily accessible when the package is opened. This is accomplished by making the bag from film that curls or bends away from the slider on one or both sides thereof when the package is opened. The invention is further directed to a method of manufacturing such packages.

One aspect of the invention is a reclosable package comprising a receptacle and a header that communicate via a mouth, and a slider-zipper assembly disposed in the mouth, the slider being exposed when a first portion of the header is removed. The header further comprises a second portion having a state of tension that will cause the second portion of the header to curl or bend away from the slider when the first portion of the header is removed.

Another aspect of the invention is a reclosable package comprising: a receptacle having a mouth, the receptacle comprising first and second receptacle walls that are joined or connected to each other along three sides of the receptacle and that are not joined or connected to each other along the mouth; first and second interlockable profiled closure members respectively joined or connected to the first and second receptacle walls along the mouth, the mouth being closed when the first and second profiled closure members are interlocked with each other and the mouth being open when the first and second profiled closure members are disengaged from each other; a slider mounted to the first and second profiled closure members and movable therealong in either a mouth opening direction or a mouth closing direction; and a header enclosing a space partially occupied by the slider and the first and second profiled closure members. The header comprises a first header wall disposed adjacent to the first profiled closure member and a second header wall disposed adjacent the second profiled closure member. At least a portion of the first header wall has a differential shrink tension state.

A further aspect of the invention is a reclosable package comprising: a receptacle having a mouth, the receptacle comprising first and second receptacle walls that are joined or connected to each other along three sides of the receptacle and that are not joined or connected to each other along the mouth; first and second interlockable profiled closure members respectively joined or connected to the first and second receptacle walls along the mouth, the mouth being closed when the first and second profiled closure members are interlocked with each other and the mouth being open when the first and second profiled closure members are disengaged from each other; a slider mounted to the first and second profiled closure members and movable therealong in either a mouth opening direction or a mouth closing direction; and a mouth wall disposed adjacent to the first profiled closure member and comprising a portion curled away from the slider.

Yet another aspect of the invention is a method of manufacture comprising the following steps: forming, filling and sealing a reclosable package comprising a slider-zipper assembly and a sealed header made of heat shrinkable material; and heat treating respective zones of the exterior surfaces of opposing sides of the sealed header by applying heat externally, the zones running generally parallel to the zipper. The amount of applied heat produces a state of differential shrink tension in each zone.

Another aspect of the invention is a reclosable package comprising a sealed film enclosure, a zipper inside and mounted to the sealed film enclosure, and a slider mounted to the zipper, the zipper and an upper part of the sealed film enclosure forming a first compartment, and the zipper and a lower part of the sealed film enclosure forming a second compartment, the slider being situated in the first compartment and a product being situated in the second compartment, wherein a first portion of the upper part of the sealed film enclosure is in a state of differential shrink tension that will cause the first portion to curl or bend away from the slider when a second portion of the upper part of the sealed film enclosure contiguous with the first portion is severed from the first portion along a line.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
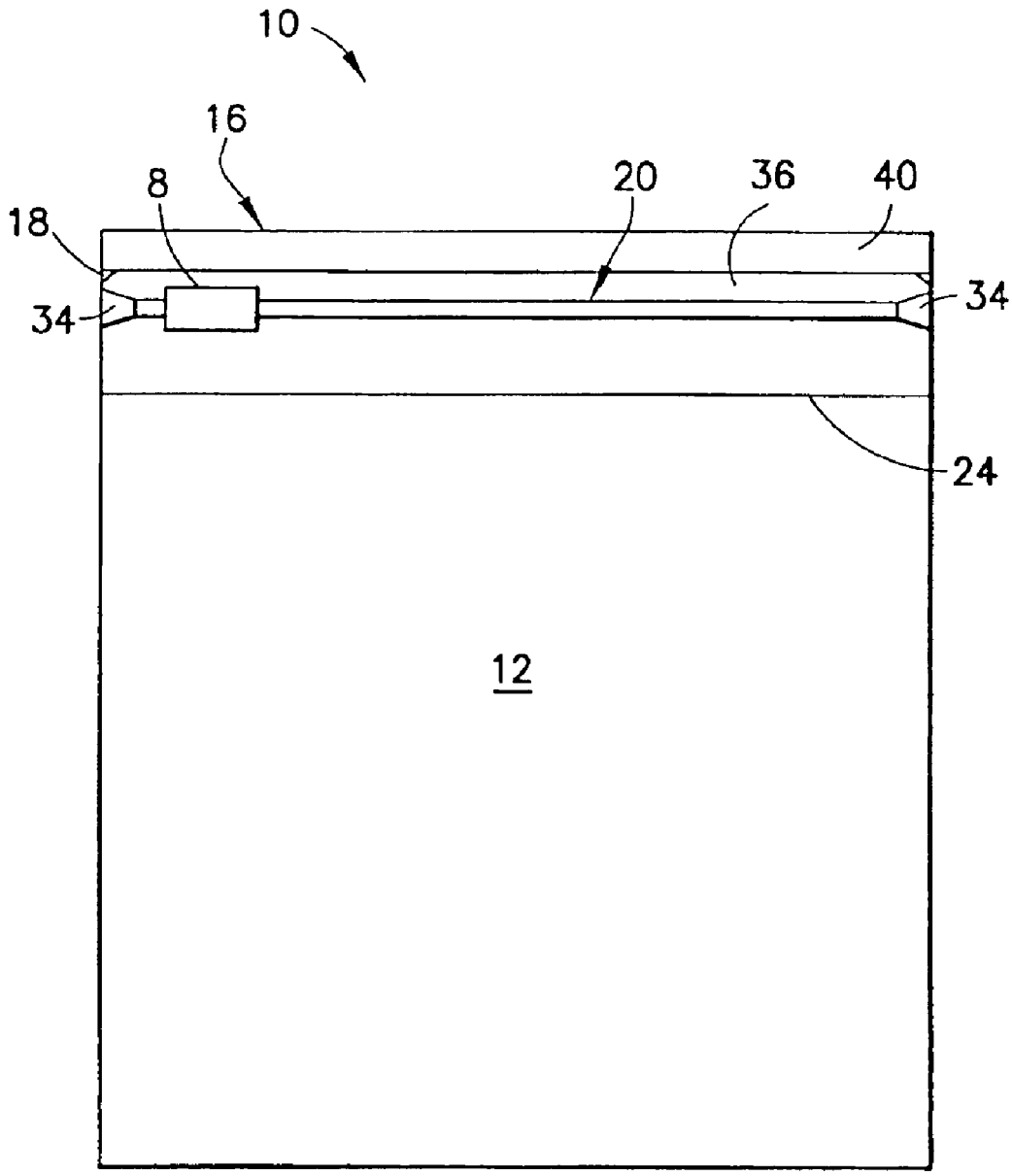
FIG. 1 is a drawing showing a front view of a conventional reclosable package having a slider-zipper assembly installed in the mouth of the package.
Figure 2:
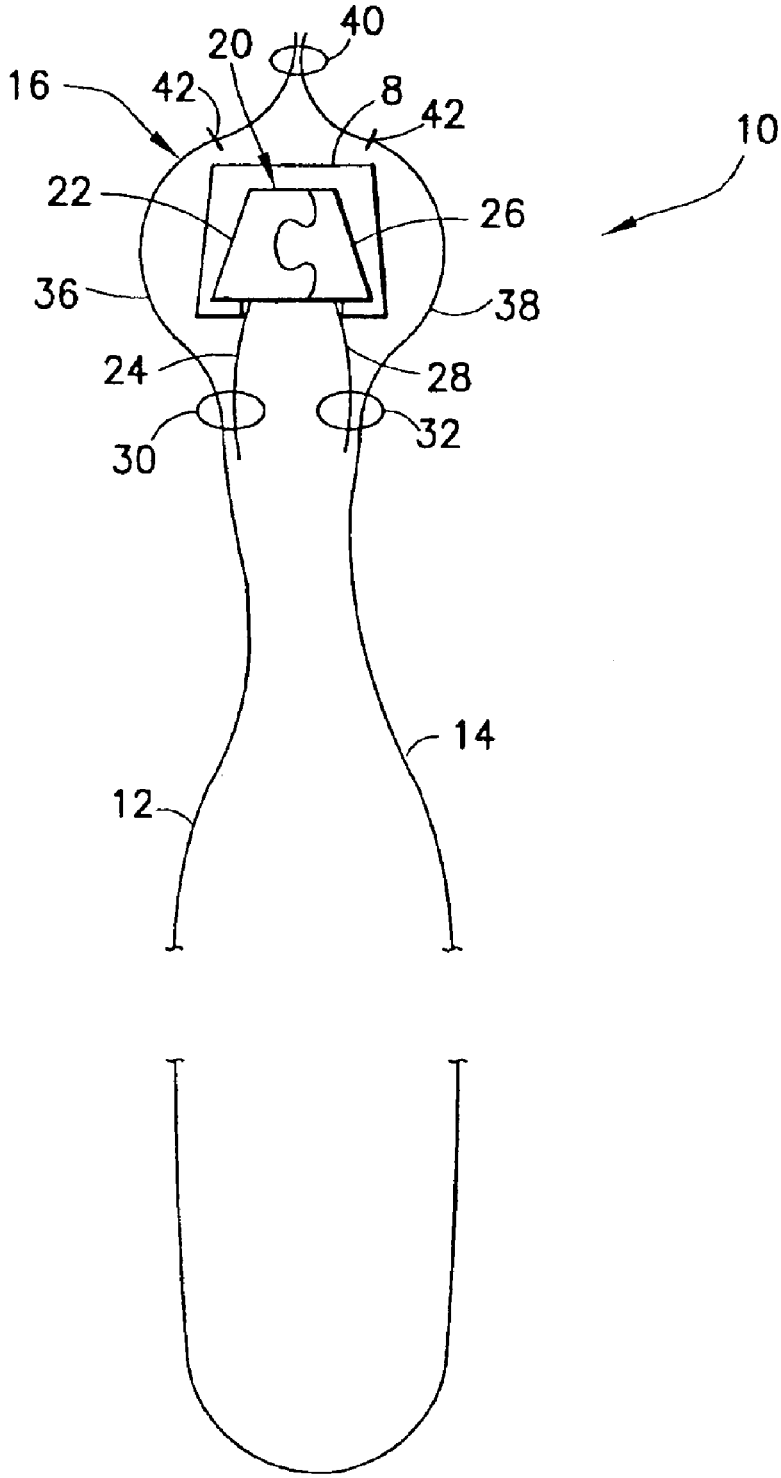
FIG. 2 is a drawing showing a sectional view of one type of reclosable bag having a slider-zipper assembly in a space enclosed by a header.

FIGS. 1 and 2 depict a reclosable package 10 comprising a receptacle with a mouth at the top, the receptacle being formed by a front wall 12 and a rear wall 14 (visible in FIG. 2 only) that is opposite to the front wall. The front and rear walls are typically formed from clear thermoplastic film heat sealed as necessary to form hermetically sealed junctures for the various portions of the package, e.g., along the sides if folded along the bottom or along a central seam and along the bottom if folded along the sides. The receptacle walls 12 and 14 are formed of a suitable plastic film material for the product to be contained within the package. For example, the film may be a laminate or coextrusion comprising a gas barrier layer and/or a low-melting-point sealant layer.

Referring to FIG. 2, a plastic zipper 20 is situated in the mouth of the receptacle. The zipper 20 comprises a closure member 22 having a female profile and a closure member 26 having a male profile that interlocks with the female profile in the zipper section being closed as a slider 8 travels in the closing direction. The zipper 20 further comprises a zipper flange 24 having one end connected or joined to profiled closure member 22 and a zipper flange 28 having one end connected or joined to profiled closure member 26.

As seen in FIG. 2, the zipper flange 24 is secured to the bag front wall 12 by a permanent seal 30 proximal to the top of the bag, while zipper flange 28 is secured to the bag rear wall 14 by a permanent seal 32. The permanent seals 30 and 32 are indicated by ovals. It should be appreciated that each permanent seal is a band of joined, e.g., fused, material that extends from one side seal of the bag to the other side seal, thereby securing the zipper to the bag along the width of the bag. The permanent seals 30 and 32 are generally parallel to each other and may be formed by any conventional method, such as conduction heat sealing.

The slider 8 is mounted to the profiled closure members 22 and 26 of the zipper 20 to facilitate zipper opening and closing. FIG. 1 shows the slider 8 in a position corresponding to closure of the zipper 20. Moving the slider 8 toward the right-hand side would disengage the interlockable closure members of the zipper and moving the slider back to the closed position shown in FIG. 1 would bring the interlockable closure members 22, 26 of the zipper 20 into full engagement once again. For proper functioning, the interlockable closure members 22 and 26 have spot seals or ultrasonic stomps 34 at the ends of the zipper halves. These seals ensure the zipper strips will not come apart during use and provide end stops for stopping the slider 8. The slider 8 is preferably made of a resilient plastic material, such as delrin, polypropylene, PBT, etc.

The slider 8 has a closing end and an opening end. The closing end is shaped to force the profiled closure members 22 and 26 into engagement when the slider 8 travels in the closing direction. The closing end is so-called because it is the end where the zipper profiled closure members 22, 26 are forced into engagement when the slider 8 is moved in the closing direction, i.e., opposite to the closing end of the slider. During slider travel in the closing direction, the closing end is the trailing end of the slider.

Prior to opening of the package by the consumer, the slider-zipper assembly is frequently covered on the consumer side by an enclosed header 16 that is hermetically sealed. Referring to FIG. 2, the sealed header 16, which provides a tamper-evident feature, comprises front and rear header walls 36 and 38 that are integrally formed with the front and rear walls 12 and 14, respectively, of the receptacle, and are sealed to each other along zone 40 at the top of the package. The numeral 40 in FIG. 1 designates a hard seal, i.e., a seal that is not intended to be broken, at the top of the header. Alternatively, the header may comprise a pair of opposing panels, the bottom edges of the header panels being joined to the top edges of the receptacle walls by conduction heat sealing, and the top edges of the panels being heat sealed to each other. In accordance with a further alternative, the bottom edges of the header and the top edges of the receptacle can be respectively heat sealed to the respective zipper flanges. In accordance with a further alternative, instead of a header having a top seal, the opposed header walls 36 and 38 may be formed by folding a piece of film and attaching the edges to the top edges of walls 12 and 14 of the receptacle or to the respective zipper flanges.

The sealed header 16 preferably has respective tear notches 18 formed in each side seal of the header, where the consumer can initiate tearing off of the sealed header from the package. The tear notches may be formed at an elevation above the top of the zipper so that the zipper does not interfere with tearing off of the top portion of the header at the height of the tear notch. Slits can be used instead of notches. Optionally, lines of weakened tear resistance 42 (see FIG. 2) can be formed in the header walls or panels at the height of the tear notches, extending across the width of the header. The lines 42 of weakened tear resistance may be lines of spaced perforations, score lines, or thinned-die lines with less plastic extruded along the lines. The topmost portion of the header will be severed along the lines of weakened tear resistance as the consumer tears open the header. Alternatively, instead of providing tear notches, horizontal dashed or dotted lines can be imprinted on the header panels at a height above the top of the zipper, indicating where the consumer should cut the package to open it.

It should be appreciated that the front panel or wall 36 of the header 16 and the front wall 12 of the receptacle are shown in FIG. 1 as being made of relatively transparent thermoplastic material. Therefore, the slider-zipper assembly is visible through the clear walls and has not been depicted as hidden. Obviously, the degree of optical transparency is irrelevant to the present invention. The bag making film may be transparent, opaque or any degree of translucence therebetween.

Figure 3:
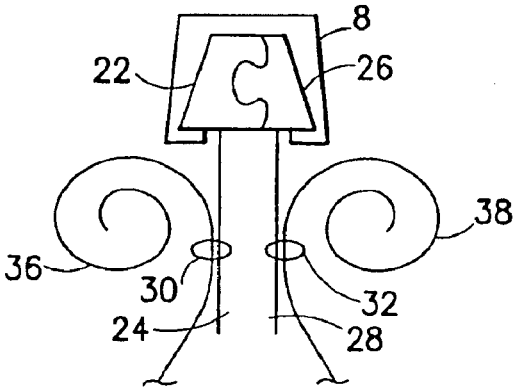
FIG. 3 is a drawing showing a partial sectional view of a reclosable package having walls above the zipper line that curl away from the slider when the top of the package is torn or cut off in accordance with one embodiment of the invention.

In accordance with one embodiment of the present invention generally depicted in FIG. 3, the walls of the sealed header are in a state of uneven or differential shrink tension such that when the top of the sealed header is severed from the remainder of the header, the remnants of header walls 36 and 38 will curl away from the slider-zipper assembly. In the example depicted in FIG. 3, the remnants of walls 36 and 38 each curl outward and downward, thereby exposing more of the slider and facilitating easy access to the slider by the consumer, who must grip the slider between a thumb and a forefinger in order to move the slider in a zipper opening direction. Preferably, both header walls are in a state of uneven shrink tension, although the broad scope of the invention encompasses having only one of the two header walls in this state.

In accordance with the embodiment shown in FIG. 3, the header walls 36 and 38 are made of a packaging film that has the aforementioned property of curling when released from a state of uneven shrink tension. One example of a suitable packaging film is a thermoplastic laminate film material comprising a first layer made of a first thermoplastic material and a second layer made of a second thermoplastic material different than said first thermoplastic material, the first and second layers having different shrink tension states prior to removal of a restraint. The restraint is applied during the process of header sealing. For example, two header panels that tend to curl outward can be sealed at their bottom edges to the top edges of the receptacle or to the zipper flanges and sealed at their top and side edges to each other while the panels are held in an uncurled state. The seals will thereafter restrain the panels from curling. The result will be a relatively higher shrink tension in the outer layers of the laminated header panels and a relatively lower shrink tension in the inner layers of the laminated header panels. Thus, when the top of the header is removed and the remnants of the header panels are released from their restraints, portions of the header panels (i.e., those portions not restrained by the header panel side seals) are free to curl outward and downward, i.e., away from the slider.

The first and second layers of the laminated film material may each comprise a different blend of two or more thermoplastic materials. As used in the claims, the recitation of a first thermoplastic material and a second thermoplastic material different than the first thermoplastic material should be construed broadly to include different polymers or copolymers as well as different blends of polymers or copolymers.

Figure 4:
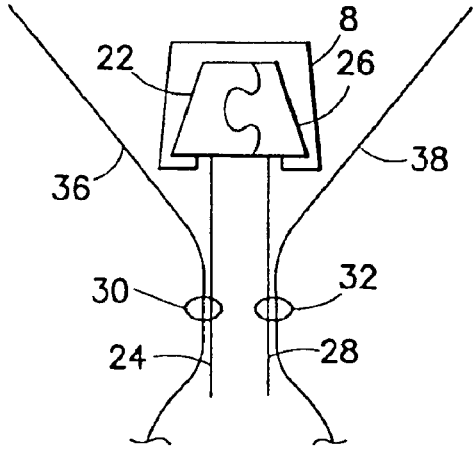
FIG. 4 is a drawing showing a partial sectional view of a reclosable package having walls above the zipper line that bend away from the slider when the top of the package is torn or cut off in accordance with another embodiment of the invention.

Alternatively, the packaging film used to make the header panels can be a thermoplastic film material having a differential shrink tension state in a thickness direction. For example, a heat shrinkable film can be sealed in place and then heat treated in such a way that only one side of the film shrinks, thereby creating a difference in shrink tension between the two sides of the film. In accordance with one method of manufacture, forming, filling and sealing steps are performed in conventional manner to produce a reclosable package comprising a slider-zipper assembly and a sealed header made of heat shrinkable thermoplastic material; and then respective zones of the exterior surfaces of opposing sides of the sealed header are heat treated by applying heat externally, e.g., using a hot air blower. The zones of heat treatment run generally parallel to the zipper and are disposed adjacent the zipper. The amount of applied heat produces a state of differential shrink tension in each zone. Later, when the top portion of the header is removed, the released remnants of the header walls or panels will curl outward and downward or bend outward, depending on the width of each heat-treated zone. FIG. 4 depicts an embodiment wherein the header walls or panels 36 and 38 bend outward when the top portion of the header is removed. More precisely, in the case where the heat-treated zone is a narrow band, curling will occur only in that narrow band, causing an uncurled portion of the header wall or panel above the narrow band to swing away from the slider.

The method may further comprise the step, performed prior to zonal heat treatment, of orienting molecules in the thermoplastic film material from which the header is made.

The polyolefins and polyvinyl chlorides are two families of plastic resins from which shrink films for packaging purposes can be made. Other resin families from which shrink films can be made include the ionomers, polyesters, polystyrenes, and polyvinylidene chlorides. Shrinkable polyolefins include monolayer films such as cross-linked or un-cross-linked oriented polyethylene, oriented polypropylene, and oriented ethylene-propylene copolymers. The polyvinyl chloride shrink films may comprise monolayer films consisting of a variety of formulations of polyvinyl chloride.

A shrink film's distinguishing characteristic is its ability upon exposure to some level of heat to shrink or, if restrained, to create shrink tension within the film. This ability is activated by the packager when the packaged product is heat treated, e.g., by injection of hot air. This process causes the heat-exposed side of the restrained header film to create shrink tension.

The manufacture of shrink films requires equipment such as extrusion lines with "orientation" capability, irradiation units when cross-linking is desired, tenter frames, mechanical centerfolders, and slitters. "Racking" or "tenter framing" are orientation processes which cause the material to be stretched in the cross or transverse direction and in the longitudinal or machine direction. The films are usually heated to their orientation temperature range, which varies with different polymers but is usually above room temperature and below the polymer's melting temperature. After being stretched, the film is rapidly cooled to quench it, thus freezing the molecules of the film in their oriented state. Upon heating, the orientation stresses are released and the film will begin to shrink back to its original, unoriented dimension.

Figure 5:
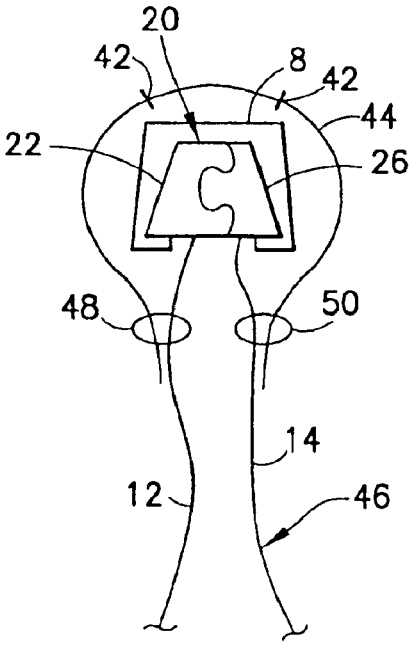
FIG. 5 is a drawing showing a sectional view of a reclosable bag in accordance with an alternative embodiment of the invention.

Alternatively, a header with curling or bending walls can be incorporated in a reclosable bag of the type shown in FIG. 5. In this case, the marginal portions of a folded header 44 are respectively attached to opposing walls 12 and 14 of a reclosable bag 46 (the profiled closure members 22 and 26 of the zipper being integrally formed with the respective walls 12 and 14 of the bag) by means of permanent heat seals 48 and 50. The header 44 may be provided with lines of weakened tear resistance 42.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. A reclosable package comprising a receptacle and a header that communicate via a mouth, and a slider-zipper assembly disposed in said mouth, said slider being exposed when a first portion of said header is removed, said header further comprising a second portion having a state of tension that will cause said second portion of said header to curl or bend away from said slider when said first portion of said header is removed.

2. The package as recited in claim 1, wherein said header further comprises a third portion having a state of tension that will cause said third portion of said header to curl or bend away from said slider when said first portion of said header is removed, said second and third portions curling or bending in opposite directions.

3. The package as recited in claim 1, wherein said second portion of said header comprises a thermoplastic laminate film material, said laminate film material in turn comprising a first layer made of a first thermoplastic material and a second layer made of a second thermoplastic material different than said first thermoplastic material, said first and second layers having different shrink tension states prior to removal of said first portion of said header.

4. The package as recited in claim 1, wherein said second portion of said header comprises a thermoplastic film material having a differential shrink tension state in a thickness direction.

5. The package as recited in claim 1, wherein said second portion of said header comprises a thermoplastic film material that has been heat treated on one side but not on the other side.

6. The package as recited in claim 5, wherein said thermoplastic film material comprises oriented molecules.

7. The package as recited in claim 1, wherein said header further comprises a notch or slit for initiating tearing along a line that severs said first portion of said header from the remainder of said header.

8. The package as recited in claim 1, wherein said header is joined to said receptacle or to said zipper.

9. The package as recited in claim 1, wherein said header is integrally formed with said receptacle.

10. The package as recited in claim 1, wherein said header comprises first and second panels that are joined at the top.

11. A reclosable package comprising:

a receptacle having a mouth, said receptacle comprising first and second receptacle walls that are joined or connected to each other along three sides of said receptacle and that are not joined or connected to each other along said mouth;

first and second interlockable profiled closure members respectively joined or connected to said first and second receptacle walls along said mouth, said mouth being closed when said first and second profiled closure members are interlocked with each other and said mouth being open when said first and second profiled closure members are disengaged from each other;

a slider mounted to said first and second profiled closure members and movable therealong in either a mouth opening direction or a mouth closing direction; and a header enclosing a space partially occupied by said slider and said first and second profiled closure members, said header comprising a first header wall disposed adjacent to said first profiled closure member and a second header wall disposed adjacent said second profiled closure member, wherein at least a portion of said first header wall has a differential shrink tension state.

12. The package as recited in claim 11, wherein the shrink tension on one side of said portion of said first header wall is greater than the shrink tension of the other side of said portion of said first header wall.

13. The package as recited in claim 12, wherein said one side and said other side of said first header wall are the outside and inside, respectively, of said first header wall.

14. The package as recited in claim 12, wherein said first header wall is made of a thermoplastic film material that has been treated on only said one side to produce said differential shrink tension state.

15. The package as recited in claim 14, wherein said thermoplastic film material of said first header wall has been heat treated on said treated side.

16. The package as recited in claim 15, wherein said thermoplastic film material of said first header wall comprises oriented molecules.

17. The package as recited in claim 11, wherein at least a portion of said second header wall also has a differential shrink tension state.

18. The package as recited in claim 11, wherein said first header wall comprises a thermoplastic laminate film material, said laminate film material in turn comprising a first layer made of a first thermoplastic material and a second layer made of a second thermoplastic material different than said first thermoplastic material, said first and second layers having different shrink tension states.

19. The package as recited in claim 11, wherein said first and second header walls are joined or connected to each other at respective opposing ends thereof.

20. The package as recited in claim 11, wherein said first and second header walls are at least partially disconnected from each other at respective opposing ends thereof.

21. The package as recited in claim 11, wherein said first header wall is joined to said first receptacle wall.

22. The package as recited in claim 11, wherein said first header wall and said first receptacle wall are integrally formed.

23. The package as recited in claim 11, further comprising a first zipper flange integrally formed with said first profiled closure member and a second zipper flange integrally formed with said second profiled closure member, said first receptacle wall being joined to said first zipper flange and said second receptacle wall being joined to said second zipper flange.

24. The package as recited in claim 11, wherein said first profiled closure member is integrally formed with said first receptacle wall and said second profiled closure member is integrally formed with said second receptacle wall.

25. A method of manufacture comprising the following steps:

forming, filling and sealing a reclosable package comprising a slider-zipper assembly and a sealed header made of heat shrinkable material; and heat treating respective zones of the exterior surfaces of opposing sides of said sealed header by applying heat externally, said zones running generally parallel to said zipper, wherein the amount of applied heat produces a state of differential shrink tension in each zone.

26. The method as recited in claim 25, further comprising the step of orienting molecules in a thermoplastic film material prior to said heat treating step, said sealed header being made from said oriented thermoplastic film material.

27. A reclosable package comprising a sealed film enclosure, a zipper inside and mounted to said sealed film enclosure, and a slider mounted to said zipper, said zipper and an upper part of said sealed film enclosure forming a first compartment, and said zipper and a lower part of said sealed film enclosure forming a second compartment, said slider being situated in said first compartment and a product being situated in said second compartment, wherein a first portion of said upper part of said sealed film enclosure is in a state of differential shrink tension that will cause said first portion to curl or bend away from said slider when a second portion of said upper part of said sealed film enclosure contiguous with said first portion is severed from said first portion along a first line.

28. The package as recited in claim 27, wherein a third portion of said upper part of said sealed film enclosure, contiguous with said second portion, is in a state of differential shrink tension that will cause said third portion to curl or bend away from said slider when said second portion is severed from said third portion along a second line.

29. A reclosable package comprising:

a receptacle comprising front and rear walls and having a mouth formed in part by portions of said front and rear walls;

a zipper comprising first and second mutually interlockable zipper parts, said first zipper part comprising a first profiled closure member and a first zipper flange joined to said portion of said front wall, and said second zipper part comprising a second profiled closure member and a second zipper flange joined to said portion of said rear wall, said mouth being closed when said first and second profiled closure members are interlocked and open when said first and second profiled closure members are disengaged;

a slider mounted on said zipper for travel therealong in a mouth opening direction or a mouth closing direction; and a header passing over said slider and said first and second profiled closure members and open at both ends, said header comprising first and second header walls respectively joined to or integrally formed with said respective portions of said first and second receptacle walls, wherein said first header wall comprises a first line of weakened tear resistance extending across a substantial portion of the length of said header, a substantial portion of said first line being disposed at an elevation above said first and second profiled closure members.

30. The package as recited in claim 29, wherein said second header wall comprises a second line of weakened tear resistance extending across a substantial portion of the length of said header, a substantial portion of said second line being disposed at said elevation.

31. The package as recited in claim 29, wherein said first line of weakened tear resistance is a line of spaced perforations.

32. The package as recited in claim 29, wherein said first line of weakened tear resistance is a score line.

33. The package as recited in claim 29, wherein said first header wall is integrally formed with said second header wall, and said first and second header walls are joined with said first and second receptacle walls respectively.

34. The package as recited in claim 29, wherein said first header wall is joined to said second header wall above said zipper, and said first and second header walls are integrally formed with said first and second receptacle walls respectively.

35. The package as recited in claim 29, wherein said entire first line is disposed at said elevation.

36. The package as recited in claim 29, wherein said first line is disposed at said elevation for a distance equal to at least one-half of said length of said header.

37. The package as recited in claim 29, wherein said first line is disposed at said elevation for a distance equal to at least three-quarters of said length of said header.

* * * * *